United States Patent [19]

Zegar

[11] Patent Number: 4,487,347

[45] Date of Patent: Dec. 11, 1984

[54] GOLF BAG AND CARRYING DEVICE

[76] Inventor: Michael A. Zegar, 1 Brookview Rd., Whitehouse Station, N.J. 08889

[21] Appl. No.: 531,405

[22] Filed: Sep. 12, 1983

[51] Int. Cl.[3] ..... A45C 13/30

[52] U.S. Cl. ..... 224/259; 206/315.5

[58] Field of Search ..... 224/260, 209, 913, 259, 224/210, 209, 150, 261, 272, 916, 917; 206/315.2, 315.3, 315.5

[56] References Cited

U.S. PATENT DOCUMENTS 1,607,802 11/1926 Schank ..... 206/315.3
1,879,480 9/1932 Pures ..... 224/260
2,482,372 9/1949 Rossow ..... 206/315.2
2,853,111 9/1958 Williams ..... 224/259

*Primary Examiner*—Stephen Marcus
*Assistant Examiner*—David Voorhees
*Attorney, Agent, or Firm*—Kenneth P. Glynn

[57] ABSTRACT

The present invention comprises a golf bag and a carrying device. It includes an elongated rigid bar which is attachable to a conventional single strap golf bag. The bar includes perforations and two shoulder straps are attachable thereto at the perforations. In one embodiment, the two shoulder straps are designed to be adjustable and include provision for quick attachment to and detachment from the elongated rigid bar.

15 Claims, 5 Drawing Figures

GOLF BAG AND CARRYING DEVICE

BACKGROUND OF THE INVENTION

1. Field of The Invention

The present invention relates to a carrying means, and more particularly to a golf bag and carrying device combination. Frequently, golfers carry their own golf bags either to save the expense of a caddy or cart, or because neither is available. Single strap bags are carried with great difficulty due to imbalance, excessive weight on one shoulder, tendency of clubs to slide out of the bag, etc. The present invention is directed to solving these problems.

2. Prior Art Statement

U.S. Pat. No. 4,182,470 issued to Kenneth Atkinson on Jan. 8, 1980, illustrates a mechanism which includes a belt which is adapted to be worn around a person's waist and which has attached to it at least one magnetic member which will hold metallic objects by magnetism. Typically, two discs are employed—one attached to the belt, the other attached to a bag to be carried. The carrying of a golf bag is illustrated and discussed and removable attachment or permanent attachment of the metal parts (including a magnet) may be used. Unfortunately, the teachings of this patent lead one to the method of carrying a golf bag using a single strap and a belt. While weight redistribution may be established, the imbalance which is inherent in using one shoulder and not the other for carrying, is not alleviated.

U.S. Pat. No. 2,853,111, issued to Anna Williams on Sept. 23, 1958 shows a golf bag having two straps, for weight distribution and ease of carrying golf bags. However, the teachings of Williams are directed to newly manufactured golf bags wherein the straps are integral parts of the bag. Adjustable buckles are suggested so that the bag may be slightly tilted. However, no teachings are presented which would enable the owner of a single strap conventional golf bag to convert it readily to a double strap arrangement, as in the present invention.

BRIEF SUMMARY OF THE INVENTION

The present invention comprises a golf bag and a carrying device. It includes an elongated rigid bar which is attachable to a conventional single strap golf bag. The bar includes perforations and two shoulder straps are attachable thereto at the perforations.

DETAILED DESCRIPTION OF THE PRESENT INVENTION, INCLUDING THE DRAWINGS

The present invention, as mentioned, basically embodies a conventional single shoulder strap type golf bag and a carrying device. The single shoulder strap golf bag has at least two attachment means thereon, typically the attachment means for each end of the single shoulder strap.

One component of the carrying device of the present invention is a rigid bar which is elongated and has two ends, each of which is capable of being attached to one end of the mentioned single shoulder strap golf bag attachment means. This elongated rigid bar may be constructed of any known rigid structural material which is capable of supporting the weight of a full golf bag with clubs, balls, etc. For example, treated iron, steel, composite material or other structural material may be used, although light weight materials such as aluminum and plastic are preferred.

Figure 1:
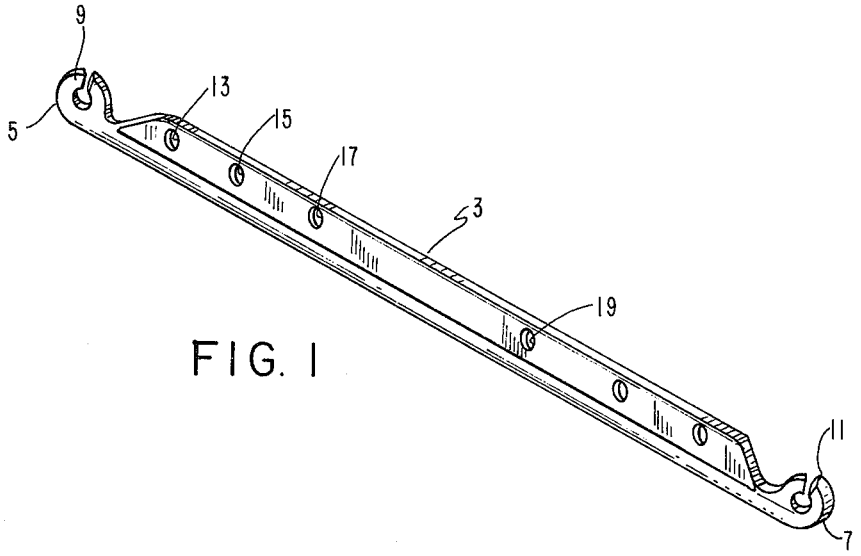
FIG. 1 illustrates an oblique view of one embodiment of the elongated rigid bar used in the present invention.
Figure 2:
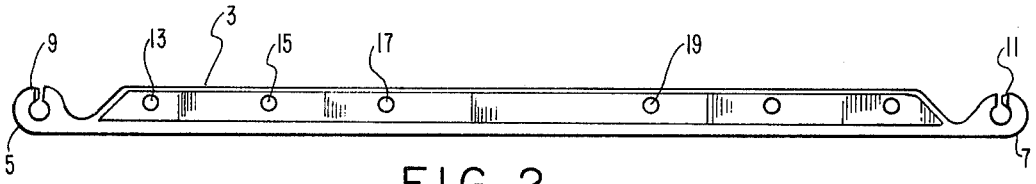
FIG. 2 illustrates a side view of said elongated rigid bar.

FIG. 1 shows an oblique view of one embodiment of the elongated rigid bar and FIG. 2 shows a side view thereof. Reference is simultaneously made to FIGS. 1 and 2, in which the elongated rigid bar is shown generally as 3. Bar 3 has two ends 5 and 7, each of which are adapted so as to be capable of being attached to attachment means of a conventional single shoulder strap golf bag. Ends 5 and 7 have been designed with attachment hooks 9 and 11, respectively, although any conventional connecting or attaching means could be used. Bar 3 further includes a plurality of perforations, exemplified by orifices 13, 15, 17 and 19.

Figure 3:
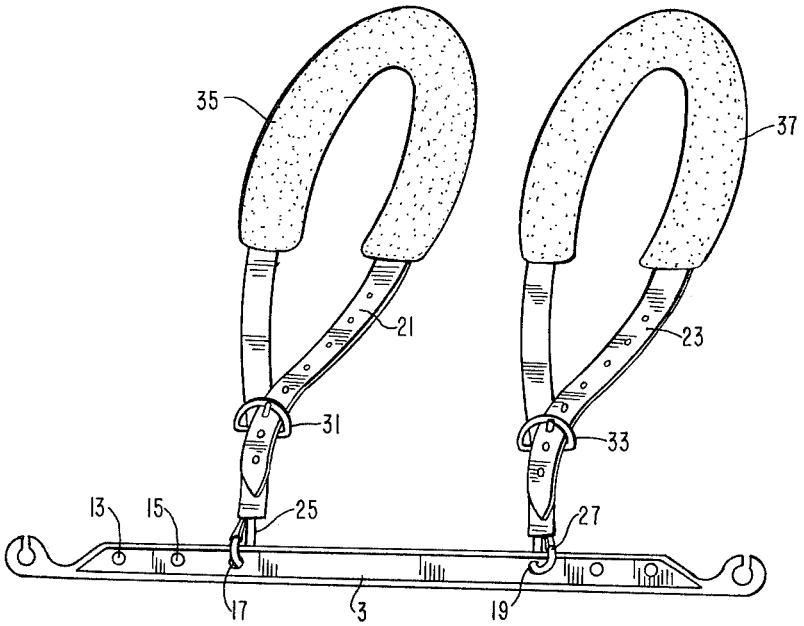
FIG. 3 shows a combination of two adjustable shoulder straps and an elongated rigid bar which may be used in the present invention device.

FIG. 3 illustrates a combination of two adjustable shoulder straps 21 and 23, attached to bar 3 at orifices 17 and 19 respectively. Straps 21 and 23 include clip-on portions 25 and 27 for quick connection to orifices 17 and 19, although any known connection means could be employed. Straps 21 and 23 are adjustable via buckles 31 and 33, although they could be non-adjustable, i.e. prefitted to the user or could be adjustable by other adjustment means, e.g. velcro, loops, hooks or football helmet stop type binders. Any means available could be substituted for the buckles. Thus, FIG. 3 shows adjustability as to strap length, and by virtue of using different orifices for stop attachment, weight distribution adjustment. In other embodiments, bar 3 may have more or fewer orifices as the designer may desire. Optional cushion pads 35 and 37 are shown but not essential.

Figure 4:
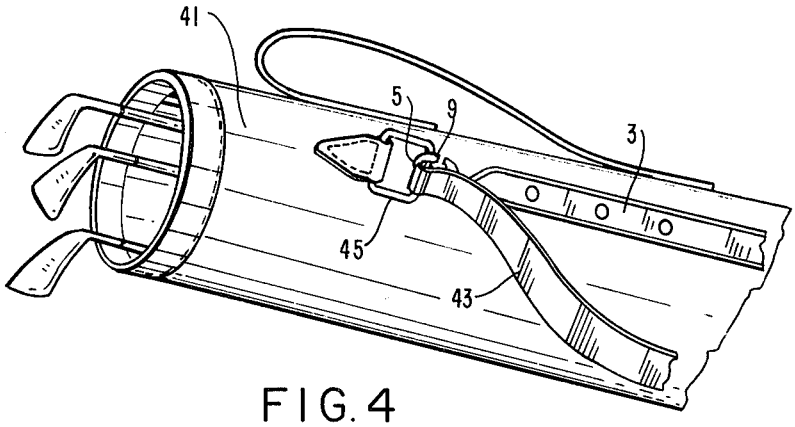
FIG. 4 illustrates a partial, close up view of one end of the device of FIGS. 1 and 2 attached to a portion of a single shoulder strap golf bag of conventional design; and, FIG. 5 shows one embodiment of the device of the present invention in use.

FIG. 4 shows a partial close up view of a conventional single shoulder strap golf bag 41, having strap 43 and strap attachment means 45. (Not shown would be a second attachment means at the other end of should strap 43.) Bar 3 is attached to means 45 at end 5 via hook 9. Bar 3 is thus used in conjunction with the straps 21 and 23 shown in FIG. 3 to constitute the carrying device.

Figure 5:
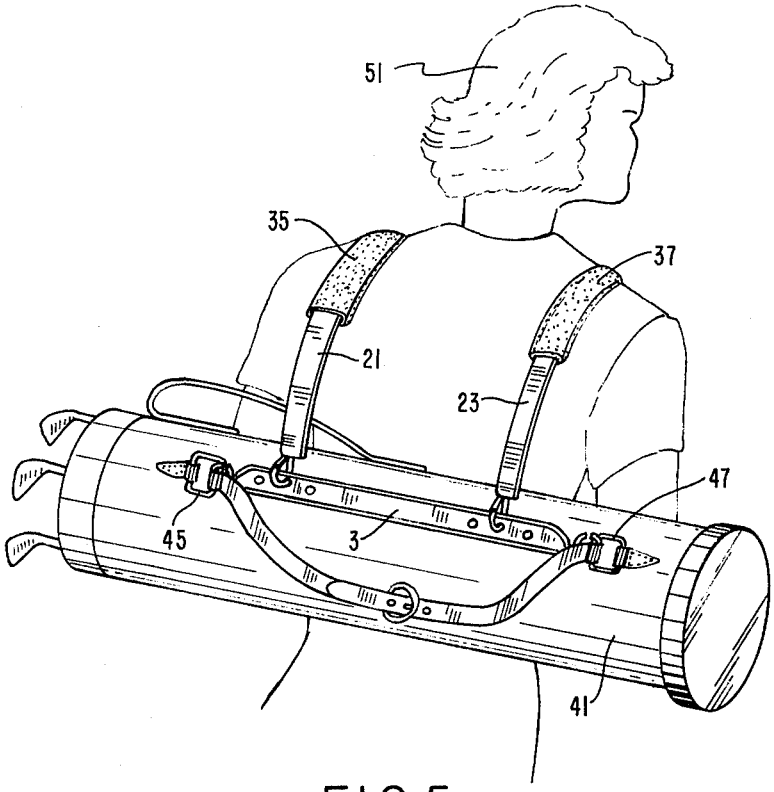

FIG. 5 illustrates a complete embodiment of the present invention. Single shoulder strap golf bag 41 has connected thereto bar 3 at attachment means 45 and 47. Bar 3 has connected thereto straps 21 and 23 as illustrated in FIG. 3. Golfer 51 is shown wearing the golf bag and carrying device with optional cushion pads 35 and 37. As can be seen in FIG. 5, the straps 21 and 23 could be attached closer together or farther apart for broader or narrower-shouldered golfers. Straps 21 and 23 may further be adjusted for tighter or looser fit or for tilting and weight redistribution by buckle adjustment.

The present invention golf bag and carrying device solves the problems inherent in single shoulder strap golf bags—weight distribution, imbalance, etc.—yet enables the golfer to "convert" a conventional bag without purchasing an entirely new golf bag. It should now be apparent to the artisan that various changes and substitutions might be made to the invention without exceeding its scope. Thus, the foregoing discussion has been presented to illustrate the present invention and the present invention should not be construed to be limited thereto.

What is claimed is:

1. A golf bag and carrying device, comprising:

(a) a single strap golf bag of conventional design and having at least two attachment means thereon;

(b) an elongated rigid bar having two ends, each end of which is capable of being attached to one of said two attachment means, said elongated rigid bar having a plurality of perforations contained therein; and, (c) two shoulder straps capable of attachment to said bar at said perforations so as to permit the carrying of said golf bag in controlled balance with weight distributed to both shoulders of the carrier.

2. The golf bag and carrying device of claim 1 wherein said elongated rigid bar is of unibody construction, each end of which is capable of being removably attached to one of said two attachment means.

3. The golf bag and carrying device of claim 1 wherein said two attachment means are rigid metal members used to attach opposite ends of a single strap to said conventional golf bag.

4. The golf bag and carrying device of claim 2 wherein said two attachment means are rigid metal members used to attach opposite ends of a single strap to said conventional golf bag.

5. The golf bag and carrying device of claim 1 wherein said elongated rigid bar is constructed of aluminum.

6. The golf bag and carrying device of claim 2 wherein said elongated rigid bar is constructed of aluminum.

7. The golf bag and carrying device of claim 3 wherein said elongated rigid bar is constructed of aluminum.

8. The golf bag and carrying device of claim 1 wherein said elongated rigid bar is constructed of plastic.

9. The golf bag and carrying device of claim 2 wherein said elongated rigid bar is constructed of plastic.

10. The golf bag and carrying device of claim 3 wherein said elongated rigid bar is constructed of plastic.

11. The golf bag and carrying device of claim 1 wherein said two shoulder straps are each adjustable in length.

12. The golf bag and carrying device of claim 2 wherein said two shoulder straps are each adjustable in length.

13. The golf bag and carrying device of claim 3 wherein said two shoulder straps are each adjustable in length.

14. The golf bag and carrying device of claim 5 wherein said two shoulder straps are each adjustable in length.

15. The golf bag and carrying device of claim 8 wherein said two shoulder straps are each adjustable in length.

* * * * *